US007136795B2

(12) United States Patent
Downton

(10) Patent No.: US 7,136,795 B2
(45) Date of Patent: Nov. 14, 2006

(54) CONTROL METHOD FOR USE WITH A STEERABLE DRILLING SYSTEM

(75) Inventor: Geoff Downton, Minchinhampton (GB)

(73) Assignee: Schlumberger Technology Corporation, Sugarland, TX (US)

( * ) Notice: Subject to any disclaimer, the term of this patent is extended or adjusted under 35 U.S.C. 154(b) by 151 days.

(21) Appl. No.: 10/604,208

(22) Filed: Jul. 1, 2003

(65) Prior Publication Data

US 2005/0006145 A1 Jan. 13, 2005

Related U.S. Application Data

(63) Continuation-in-part of application No. 09/869,686, filed as application No. PCT/GB00/04291 on Nov. 10, 2000, now Pat. No. 6,601,658.

(60) Provisional application No. 60/164,681, filed on Nov. 10, 1999.

(51) Int. Cl.
*E21B 1/00* (2006.01)

(52) U.S. Cl. ..... 703/10; 175/45; 702/9; 73/152.46

(58) Field of Classification Search ..... 175/40, 175/45, 48, 50, 61; 702/9; 73/152.03, 152.43–152.46; 33/301–303; 324/326; 703/10
See application file for complete search history.

(56) References Cited

U.S. PATENT DOCUMENTS

| | | | |
|---|---|---|---|
| 712,887 | A | 11/1902 | Wyczynski |
| 1,971,480 | A | 8/1934 | Earley |
| 2,319,236 | A | 5/1943 | Isaacks |
| 2,345,766 | A | 4/1944 | Miller |
| 2,585,207 | A | 2/1952 | Zubiln |
| 2,687,282 | A | 8/1954 | Sanders |
| 2,694,549 | A | 11/1954 | James |
| 2,712,434 | A | 7/1955 | Giles et al. |
| 2,857,141 | A | 10/1958 | Carpenter |
| 2,876,992 | A | 3/1959 | Lindsay |
| 3,051,255 | A | 8/1962 | Deely |
| 3,062,303 | A | 11/1962 | Schultz |
| 3,068,946 | A | 12/1962 | Frisby et al. |
| 3,092,188 | A | 6/1963 | Farris |
| 3,098,534 | A | 7/1963 | Carr et al. |
| 3,104,728 | A | 9/1963 | Davis |
| 3,123,162 | A | 3/1964 | Rowley |
| 3,129,776 | A | 4/1964 | Mann |
| 3,225,843 | A | 12/1965 | Ortloff et al. |
| 3,305,771 | A | 2/1967 | Arps |
| 3,309,656 | A | 3/1967 | Godbey |
| 3,370,657 | A | 2/1968 | Antle |
| 3,457,999 | A | 7/1969 | Massey |
| 3,512,592 | A | 5/1970 | Kellner |
| 3,561,549 | A | 2/1971 | Garrison et al. |
| 3,575,247 | A | 4/1971 | Feenstra |
| 3,637,032 | A | 1/1972 | Jeter |
| 3,667,556 | A | 6/1972 | Henderson |

(Continued)

FOREIGN PATENT DOCUMENTS

| | | |
|---|---|---|
| EP | 0 343 800 A2 | 11/1989 |

(Continued)

*Primary Examiner*—David Bagnell
*Assistant Examiner*—Matthew J. Smith
(74) *Attorney, Agent, or Firm*—Jennie Salazar; Victor H. Segura; Dale V. Gaudier

(57) ABSTRACT

A control method for use with a steerable drilling system comprises the steps of inputting parametric model data representative of drilling conditions and using the data to determine achievable drilling directions.

3 Claims, 5 Drawing Sheets

U.S. PATENT DOCUMENTS

| | | | | |
|---|---|---|---|---|
| 3,743,034 | A | | 7/1973 | Bradley |
| 3,799,279 | A | | 3/1974 | Farris |
| 3,878,903 | A | | 4/1975 | Chemington |
| 3,888,319 | A | | 6/1975 | Bourne, Jr. et al. |
| 3,903,974 | A | | 9/1975 | Cullen |
| 3,974,886 | A | | 8/1976 | Blake, Jr. |
| 3,997,008 | A | | 12/1976 | Kellner |
| 4,022,287 | A | | 5/1977 | Lundstrom et al. |
| 4,027,301 | A | | 5/1977 | Mayer |
| 4,040,494 | A | | 8/1977 | Kellner |
| 4,040,495 | A | | 8/1977 | Kellner et al. |
| 4,076,084 | A | | 2/1978 | Tighe |
| 4,080,115 | A | | 3/1978 | Sims et al. |
| 4,152,545 | A | | 5/1979 | Gilbreath, Jr. et al. |
| 4,184,553 | A | | 1/1980 | Jones, Jr. et al. |
| 4,185,704 | A | | 1/1980 | Nixon, Jr. |
| 4,190,123 | A | | 2/1980 | Roddy |
| 4,211,292 | A | | 7/1980 | Evans |
| 4,220,213 | A | | 9/1980 | Hamilton |
| 4,241,796 | A | | 12/1980 | Green et al. |
| 4,263,552 | A | * | 4/1981 | Weber ..... 324/326 |
| 4,270,619 | A | | 6/1981 | Base |
| 4,291,773 | A | | 9/1981 | Evans |
| 4,305,474 | A | | 12/1981 | Farris et al. |
| 4,351,037 | A | | 9/1982 | Scherbatskoy |
| 4,357,634 | A | | 11/1982 | Chung |
| 4,388,974 | A | | 6/1983 | Jones, Jr. et al. |
| 4,394,881 | A | | 7/1983 | Shirley |
| 4,407,377 | A | | 10/1983 | Russell |
| 4,416,339 | A | | 11/1983 | Baker et al. |
| 4,428,441 | A | | 1/1984 | Dellinger |
| 4,449,595 | A | | 5/1984 | Holbert |
| 4,456,080 | A | | 6/1984 | Holbert |
| 4,461,359 | A | | 7/1984 | Jones, Jr. et al. |
| 4,465,147 | A | | 8/1984 | Feenstra |
| 4,491,187 | A | | 1/1985 | Russell |
| 4,492,276 | A | | 1/1985 | Kamp |
| 4,515,225 | A | | 5/1985 | Dailey |
| 4,523,652 | A | | 6/1985 | Schuh |
| 4,560,013 | A | | 12/1985 | Beimgraben |
| 4,572,305 | A | | 2/1986 | Swietlik |
| 4,577,701 | A | | 3/1986 | Dellinger et al. |
| 4,635,736 | A | | 1/1987 | Shirley |
| 4,637,479 | A | | 1/1987 | Leising |
| 4,638,873 | A | | 1/1987 | Welborn |
| 4,655,289 | A | | 4/1987 | Schoeffler |
| 4,662,458 | A | | 5/1987 | Ho |
| 4,667,751 | A | | 5/1987 | Geczy et al. |
| 4,683,956 | A | | 8/1987 | Russell |
| 4,690,229 | A | | 9/1987 | Raney |
| 4,697,651 | A | | 10/1987 | Dellinger |
| 4,699,224 | A | | 10/1987 | Burton |
| 4,714,118 | A | | 12/1987 | Baker et al. |
| 4,732,223 | A | | 3/1988 | Schoeffler et al. |
| 4,739,843 | A | | 4/1988 | Burton |
| 4,763,258 | A | | 8/1988 | Engelder |
| 4,787,093 | A | | 11/1988 | Rorden |
| 4,794,534 | A | * | 12/1988 | Millheim ..... 702/9 |
| 4,804,051 | A | * | 2/1989 | Ho ..... 175/45 |
| 4,807,708 | A | | 2/1989 | Forrest et al. |
| 4,811,798 | A | | 3/1989 | Falgout, Sr. et al. |
| 4,821,815 | A | | 4/1989 | Baker et al. |
| 4,821,817 | A | | 4/1989 | Cendre et al. |
| 4,836,301 | A | | 6/1989 | Van Dongen et al. |
| 4,842,083 | A | | 6/1989 | Raney |
| 4,844,178 | A | | 7/1989 | Cendre et al. |
| 4,848,488 | A | | 7/1989 | Cendre et al. |
| 4,848,490 | A | | 7/1989 | Anderson |
| 4,854,397 | A | | 8/1989 | Warren et al. |
| 4,854,403 | A | | 8/1989 | Ostertag et al. |
| 4,858,705 | A | | 8/1989 | Thiery |
| 4,867,255 | A | | 9/1989 | Baker et al. |
| 4,880,067 | A | | 11/1989 | Jelsma |
| 4,886,130 | A | | 12/1989 | Evans |
| 4,895,214 | A | | 1/1990 | Schoeffler |
| 4,901,804 | A | | 2/1990 | Thometz et al. |
| 4,905,774 | A | | 3/1990 | Wittrisch |
| 4,908,804 | A | | 3/1990 | Rorden |
| 4,938,298 | A | | 7/1990 | Rehm |
| 4,947,944 | A | | 8/1990 | Coltman et al. |
| 4,948,925 | A | | 8/1990 | Winters et al. |
| 4,951,760 | A | | 8/1990 | Cendre et al. |
| 4,995,465 | A | | 2/1991 | Beck et al. |
| 5,000,272 | A | | 3/1991 | Wiebe et al. |
| 5,038,872 | A | | 8/1991 | Shirley |
| 5,050,692 | A | | 9/1991 | Beimgraben |
| 5,052,501 | A | | 10/1991 | Wenzel et al. |
| RE33,751 | E | | 11/1991 | Geczy et al. |
| 5,065,825 | A | | 11/1991 | Bardin et al. |
| 5,070,950 | A | | 12/1991 | Cendre et al. |
| 5,099,934 | A | | 3/1992 | Barr |
| 5,103,919 | A | | 4/1992 | Warren et al. |
| 5,109,935 | A | | 5/1992 | Hawke |
| 5,113,953 | A | | 5/1992 | Noble |
| 5,117,927 | A | | 6/1992 | Askew |
| 5,131,479 | A | | 7/1992 | Boulet et al. |
| 5,139,094 | A | | 8/1992 | Prevedel et al. |
| 5,160,925 | A | | 11/1992 | Dailey et al. |
| 5,163,521 | A | | 11/1992 | Pustanyk et al. |
| 5,181,576 | A | | 1/1993 | Askew et al. |
| 5,186,264 | A | | 2/1993 | du Chaffaut |
| 5,213,168 | A | | 5/1993 | Warren et al. |
| 5,220,963 | A | | 6/1993 | Patton |
| 5,224,558 | A | | 7/1993 | Lee |
| 5,265,682 | A | | 11/1993 | Russell et al. |
| 5,265,687 | A | | 11/1993 | Gray |
| 5,305,830 | A | | 4/1994 | Wittrisch |
| 5,305,838 | A | | 4/1994 | Pauc |
| 5,311,952 | A | | 5/1994 | Eddison et al. |
| 5,311,953 | A | | 5/1994 | Walker |
| 5,316,093 | A | | 5/1994 | Morin et al. |
| 5,325,714 | A | | 7/1994 | Lende et al. |
| 5,332,048 | A | | 7/1994 | Underwood et al. |
| 5,341,886 | A | | 8/1994 | Patton |
| 5,343,966 | A | | 9/1994 | Wenzel et al. |
| 5,375,098 | A | | 12/1994 | Malone et al. |
| 5,390,748 | A | | 2/1995 | Goldman |
| 5,410,303 | A | | 4/1995 | Comeau et al. |
| 5,421,420 | A | | 6/1995 | Malone et al. |
| 5,467,834 | A | | 11/1995 | Hughes et al. |
| 5,484,029 | A | | 1/1996 | Eddison |
| 5,507,353 | A | | 4/1996 | Pavone |
| 5,520,255 | A | | 5/1996 | Barr et al. |
| 5,520,256 | A | | 5/1996 | Eddison |
| 5,529,133 | A | | 6/1996 | Eddison |
| 5,553,678 | A | | 9/1996 | Barr et al. |
| 5,553,679 | A | | 9/1996 | Thorp |
| 5,582,259 | A | | 12/1996 | Barr |
| 5,594,343 | A | | 1/1997 | Clark et al. |
| 5,602,541 | A | | 2/1997 | Comeau et al. |
| 5,603,385 | A | | 2/1997 | Colebrook |
| 5,617,926 | A | | 4/1997 | Eddison et al. |
| 5,673,763 | A | | 10/1997 | Thorp |
| 5,685,379 | A | | 11/1997 | Barr et al. |
| 5,695,015 | A | | 12/1997 | Barr et al. |
| 5,706,905 | A | | 1/1998 | Barr |
| 5,738,178 | A | | 4/1998 | Williams et al. |
| 5,778,992 | A | | 7/1998 | Fuller |
| 5,803,185 | A | | 9/1998 | Barr et al. |
| 5,812,068 | A | | 9/1998 | Wisler et al. |
| 5,842,149 | A | | 11/1998 | Harrell et al. |
| 5,875,859 | A | | 3/1999 | Ikeda et al. |
| 5,959,380 | A | | 9/1999 | Gillett et al. |
| 5,971,085 | A | | 10/1999 | Colebrook |

| | | | |
|---|---|---|---|
| 6,082,470 | A | 7/2000 | Webb et al. |
| 6,089,332 | A | 7/2000 | Barr et al. |
| 6,092,610 | A | 7/2000 | Kosmala et al. |
| 6,109,372 | A | 8/2000 | Dorel et al. |
| 6,116,354 | A | 9/2000 | Buytaert |
| 6,736,221 | B1 * | 5/2004 | Chia et al. ..... 175/45 |

FOREIGN PATENT DOCUMENTS

| | | | |
|---|---|---|---|
| EP | 0 594 418 | A1 | 4/1994 |
| EP | 0 685 623 | A2 | 12/1995 |
| EP | 0 459 008 | B1 | 5/1996 |
| EP | 0 520 733 | B1 | 6/1996 |
| EP | 0 744 526 | A1 | 11/1996 |
| EP | 0 762 606 | A2 | 3/1997 |
| EP | 0 530 045 | B1 | 4/1997 |
| EP | 0 770 760 | A1 | 5/1997 |
| EP | 0 841 462 | A2 | 5/1998 |
| EP | 0 874 128 | A2 | 10/1998 |
| EP | 0 677 640 | B1 | 9/1999 |
| EP | 0 685 626 | B1 | 8/2000 |
| EP | 0 728 907 | B1 | 8/2000 |
| EP | 0 728 908 | B1 | 8/2000 |
| EP | 0 728 909 | B1 | 8/2000 |
| EP | 0 728 910 | B1 | 8/2000 |
| GB | 2 154 485 | A | 9/1985 |
| GB | 2 172 324 | A | 9/1986 |
| GB | 2 172 325 | A | 9/1986 |
| GB | 2 177 738 | A | 1/1987 |
| GB | 2 183 272 | A | 6/1987 |
| GB | 2 183 694 | A | 6/1987 |
| GB | 2 246 151 | A | 1/1992 |
| GB | 2 257 182 | A | 1/1993 |
| GB | 2 259 316 | A | 3/1993 |
| GB | 22856511 | A | 7/1995 |
| GB | 2 289 907 | A | 12/1995 |
| GB | 2 289 908 | A | 12/1995 |
| GB | 2 289 909 | A | 12/1995 |
| GB | 2 290 097 | A | 12/1995 |
| GB | 2 290 356 | A | 12/1995 |
| GB | 2 298 215 | A | 8/1996 |
| GB | 2 298 216 | A | 8/1996 |
| GB | 2 298 217 | A | 8/1996 |
| GB | 2 298 218 | A | 8/1996 |
| GB | 2 301 386 | A | 12/1996 |
| GB | 2 304 756 | A | 3/1997 |
| GB | 2 306 529 | A | 7/1997 |
| GB | 2 312 905 | A | 11/1997 |
| GB | 2 322 651 | A | 9/1998 |
| GB | 2 325 016 | A | 11/1998 |
| GB | 2 328 466 | A | 2/1999 |
| GB | 2 335 450 | A | 9/1999 |
| GB | 2 336 171 | A | 10/1999 |
| GB | 2 339 222 | A | 1/2000 |
| GB | 2 339 223 | A | 1/2000 |
| GB | 2 340 153 | A | 2/2000 |
| GB | 2 342 935 | A | 4/2000 |
| GB | 2 343 470 | A | 5/2000 |
| GB | 2 344 607 | A | 6/2000 |
| GB | 2 347 951 | A | 9/2000 |
| WO | WO 96/31679 | A1 | 10/1996 |
| WO | WO 01/34935 | A1 | 5/2001 |

* cited by examiner

CONTROL METHOD FOR USE WITH A STEERABLE DRILLING SYSTEM

CROSS REFERENCE TO RELATED APPLICATIONS

This application is a continuation in part of U.S. patent application Ser. No. 09/869,686 filed Oct. 9, 2001 now U.S. Pat. No. 6,601,658 which was filed as PCT application No. PCT/GB00/04291 filed Nov. 10, 2000, which claims priority from U.S. Provisional application No. 60/164,681 filed on Nov. 10, 1999.

BACKGROUND OF INVENTION

This invention relates to a method for use in controlling the operation of a steerable drilling system. The method is particularly suitable for use with a rotary steerable system, but may be used in other types of steerable drilling system used in the formation of subterranean wells. In particular, the invention relates to a method of predicting how a drilling system will operate, respond or react to various operating conditions and changes therein.

One type of rotary steerable system comprises a downhole assembly including a drill bit. The drill bit is carried by a drill string which is rotated typically by a well head located drive arrangement. A bias unit is included in the downhole assembly, the bias unit including a plurality of hinged pads moveable between extended and retracted positions. The pads are moved hydraulically using drilling fluid under the control of a valve arrangement. The valve arrangement is designed to permit control over the pads such that, when desired, the pads can be moved to their extended positions in turn as the bias unit rotates. By appropriate control over the pads, the bias unit can be operated to apply a sideways load on the drill bit which in turn will cause the formation of a curve in the well bore being drilled. The orientation of the curve will depend upon how the bias unit is controlled.

It has been found that a number of factors must be taken into account when controlling the operation of a rotary steerable system. For example, the rate of change of direction of the bore hole being formed in response to the application of a given command signal to the bias unit depends upon several factors associated with the drilling system, for example rotary speed, weight on bit, rate of penetration and several factors associated with the formation being drilled, for example the dip and azimuth of bedding planes. As a consequence, it is common for well bores drilled using steerable drilling systems to deviate from their desired paths. Such well bores may be of tortuous form containing many dog legs. Depending upon the orientation of the curves formed in the well bore, water or gas may tend to collect in the curves. Such accumulation of water or gas may impair subsequent use of the well bore in the extraction of oil.

SUMMARY OF INVENTION

It is an object of the invention to provide a control method for use with a steerable drilling system, the method simplifying control of the drilling system.

According to the invention there is provided a method of predicting the operation of a steerable drilling system comprising the steps of inputting parametric model data representative of drilling conditions, calculating build and turn gain, cross-coupling and bias values to derive build and turn responsiveness values, using the derived build and turn responsiveness values in controlling the operation of a steerable drilling system, measuring the actual build and turn responsiveness of the system, and calculating a reachability ellipse diagram which compares the actual build and turn responsiveness to the ideal response to predict achievable rates of penetration and build and turn responsiveness for one or more sets of later operating conditions.

The parametric model data used is conveniently derived using data collected, in real time, during drilling. The parametric model data may include data representative of one or more of the following parameters: weight on bit, rotational speed, rate of penetration, torque, pressure, inclination, dip and azimuth of bedding planes or other formation characteristics, hole curvature/gauge or other geometric conditions, bit type and condition, and errors in instrumentation readings.

The use of such a system is advantageous in that compensation can be made for the operating conditions, thus the risk of supplying the drilling system with instructions to drill a curve of too tight or too small a radius of curvature or of too great or small a length in a given direction can be reduced, thus permitting the drilling of a well bore of less tortuous form.

The ellipse diagram may be displayed in a graphic form, for example in the form of a graph of build rate response against turn rate response upon which is plotted an envelope indicating the achievable responses for one or more sets of operating conditions.

With such a display, an operator will be able to see whether it is possible to steer the drill bit of the drilling system in a given direction under one or more sets of operating conditions. The operator may then be able to modify one or more of the operating conditions over which he has some control to ensure that the operating conditions under which the drilling system is operating are such as to permit steering of the drill bit in the desired direction.

BRIEF DESCRIPTION OF DRAWINGS

The invention will further be described, by way of example, with reference to the accompanying drawings.

DETAILED DESCRIPTION

Figure 1:
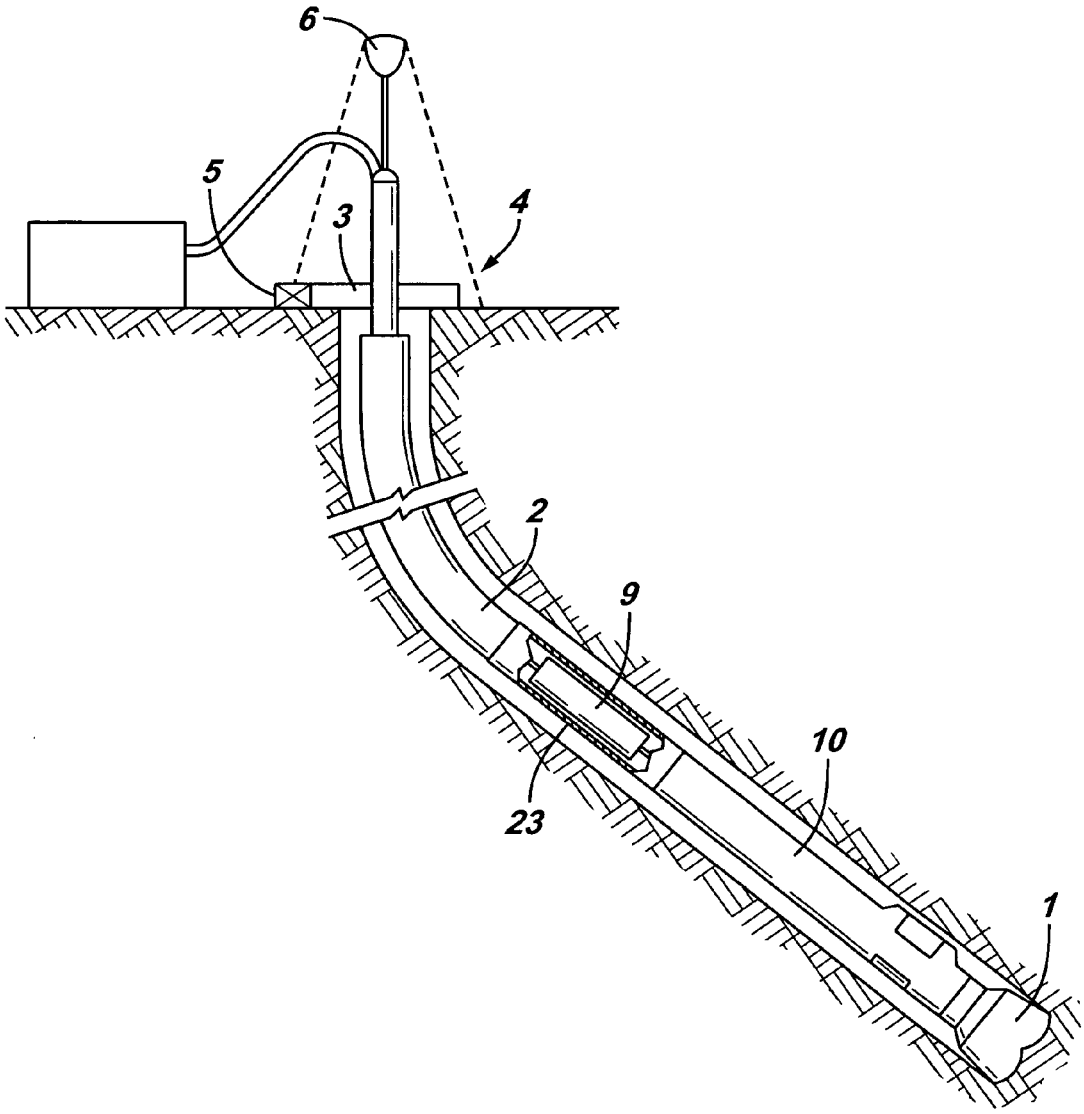
FIG. 1 is a diagram illustrating a drilling installation, with which the method of the invention may be used.

FIG. 1 shows diagrammatically a typical rotary drilling installation of a kind in which the methods according to the present invention may be employed.

In the following description the terms "clockwise" and anti-clockwise" refer to the direction of rotation as viewed looking downhole.

As is well known, the bottom hole assembly includes a drill bit 1, and is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6.

The bottom hole assembly includes a modulated bias unit 10 to which the drill bit 1 is connected and a roll stabilised control unit 9 which controls operation of the bias unit 10 in accordance with signals transmitted to the control unit from the surface. The bias unit 10 may be controlled to apply a lateral bias to the drill bitin a desired direction so as to control the direction of drilling.

Figure 2:
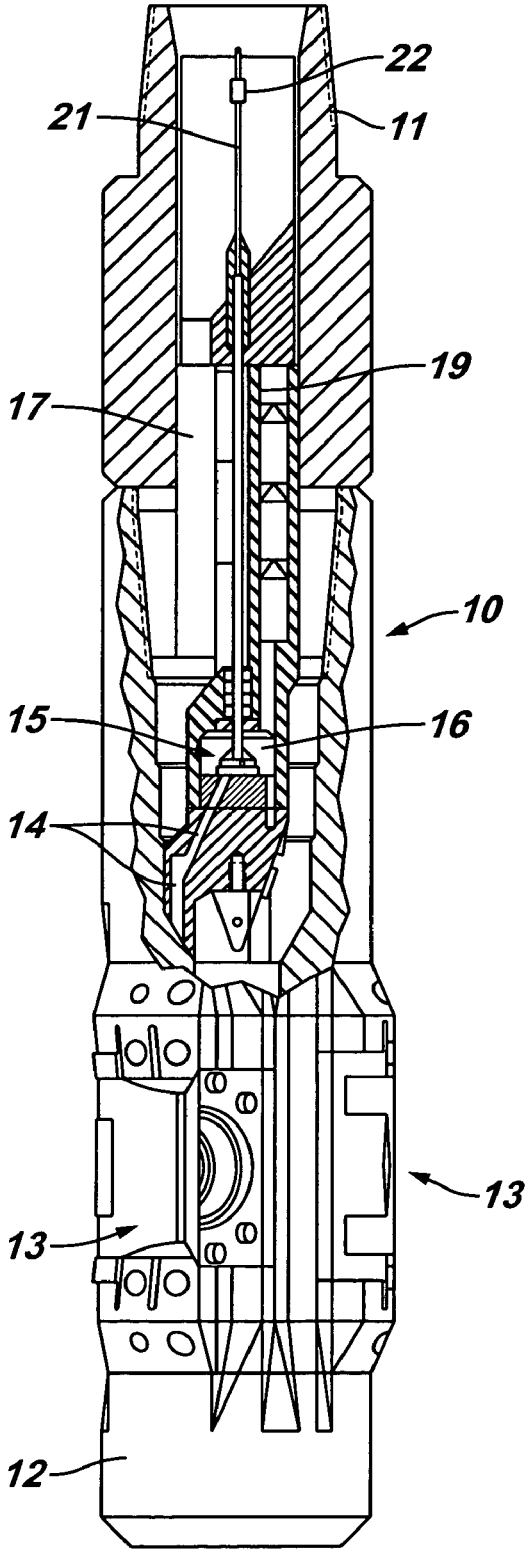
FIG. 2 is a sectional view illustrating part of the downhole assembly of the installation of FIG. 1.

Referring to FIG. 2, the bias unit 10 comprises an elongate main body structure provided at its upper end with a threaded pin 11 for connecting the unit to a drill collar, incorporating the roll stabilised control unit 9, which is in turn connected to the lower end of the drill string. The lower end 12 of the body structure is formed with a socket to receive the threaded pin of the drill bit.

There are provided around the periphery of the bias unit, towards its lower end, three equally spaced hydraulic actuators 13. Each hydraulic actuator 13 is supplied with drilling fluid under pressure through a respective passage 14 under the control of a rotatable disc valve 15 located in a cavity 16 in the body structure of the bias unit. Drilling fluid delivered under pressure downwardly through the interior of the drill string, in the normal manner, passes into a central passage 17 in the upper part of the bias unit, through a filter, and through an inlet 19 to be delivered at an appropriate pressure to the cavity 16.

The disc valve 15 is controlled by an axial shaft 21 which is connected by a coupling 22 to the output shaft of the control unit, which can be roll stabilised.

The control unit, when roll stabilised (i.e. non-rotating in space) maintains the shaft 21 substantially stationary at a rotational orientation which is selected according to the direction in which the drill bit is to be steered. As the bias unit rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally in a selected direction. The selected rotational position of the shaft 21 in space thus determines the direction in which the bias unit is actually displaced and hence the direction in which the drill bit is steered.

If the shaft 21 is not held in a substantially stationary position, then the actuators 13 are operated in turn but are not all operated in the same rotational position. As a result, rather than urging the bias unit laterally in a given direction, the direction in which the bias unit is urged changes continuously with the result that there is no net bias applied by the bias unit.

Drilling systems of the general type described hereinbefore are described in greater detail in EP 0520733, EP 0677640, EP 0530045, EP 0728908 and EP 0728909, the content of which is incorporated herein by reference.

As described hereinbefore, for a given biasing load applied by the bias unit, the rate of change of direction of the bore being formed is influenced by a number of factors. The factors influencing the vertical rate of change, the build rate, are not always the same as those influencing the rate of change in the horizontal direction, known as the turn rate.

Figure 3:
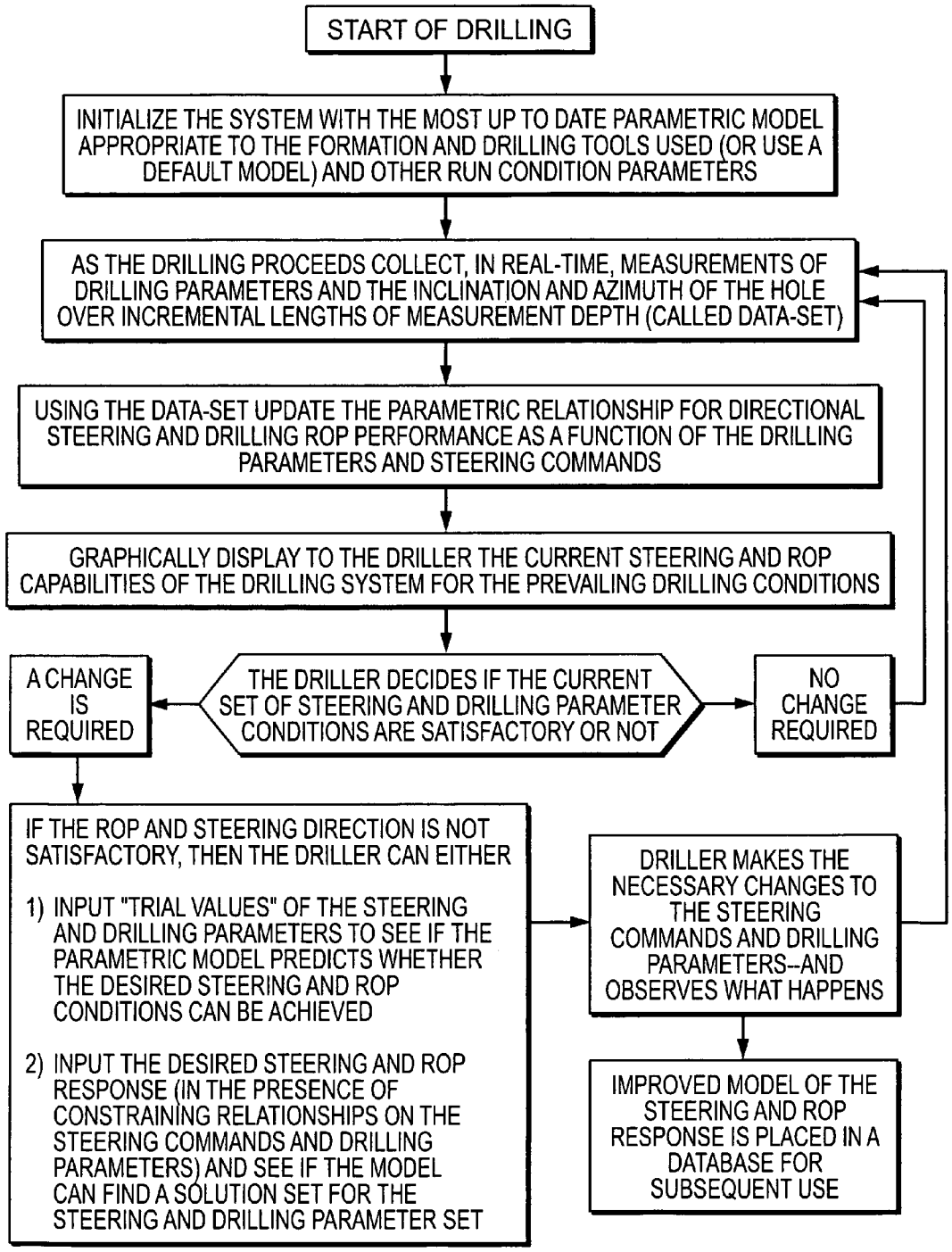
FIG. 3 is a flowchart illustrating a method in accordance with an embodiment of the invention.

FIG. 3 is a flowchart illustrating a method of controlling the operating of the drilling system of FIGS. 1 and 2. As shown in FIG. 3, at the start of drilling a control system used in controlling the position occupied by the shaft 21 is initialised with data representative of the likely drilling conditions. The input data is representative of factors associated with the drilling system, the formation being drilled, the direction of the well bore, and the shape of the well bore. The factors associated with the drilling system include the intended weight on bit, rate of penetration, rotational speed, torque, pressure and inclination of the drill bit. The factors associated with the formation being drilled include the dip and azimuth of bedding planes. Data representative of likely errors in sensor readings and representative of the type and condition of the drill bit may also be input. If no suitable data is available to be input, then a default data set may be used.

Figure 5:
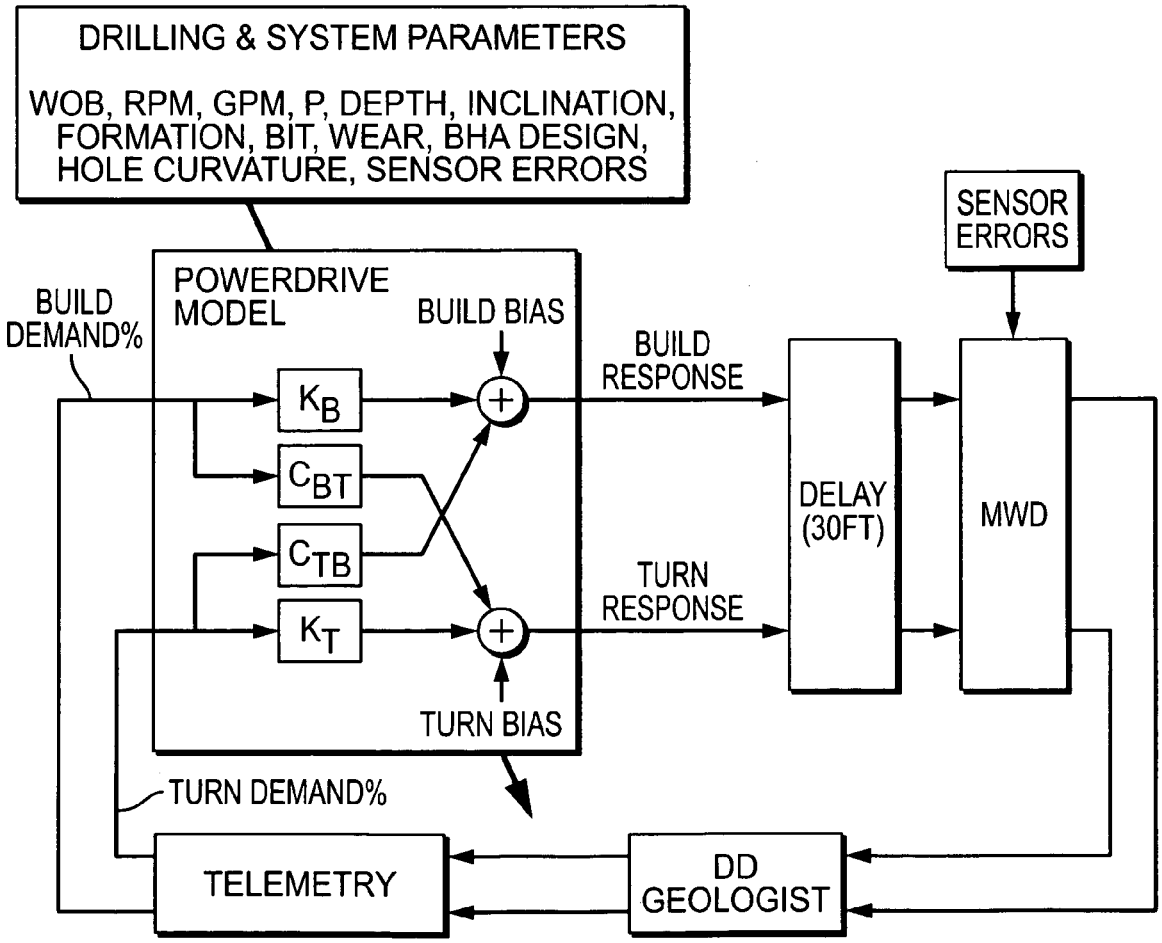
FIG. 5 is a block diagram illustrating the use of the method in conjunction with a drilling system of the type shown in FIG. 1.

Whilst drilling is taking place, data representative of the actual drilling conditions is collected and transmitted to the control system. The readings are conveniently taken at intervals, for example at every 30 metres of measured depth. The measured data is used to update the data of the parametric model. FIG. 5 is a block diagram illustrating the interrelationship between the various parts of the drilling system and the method of operation thereof.

Figure 4:
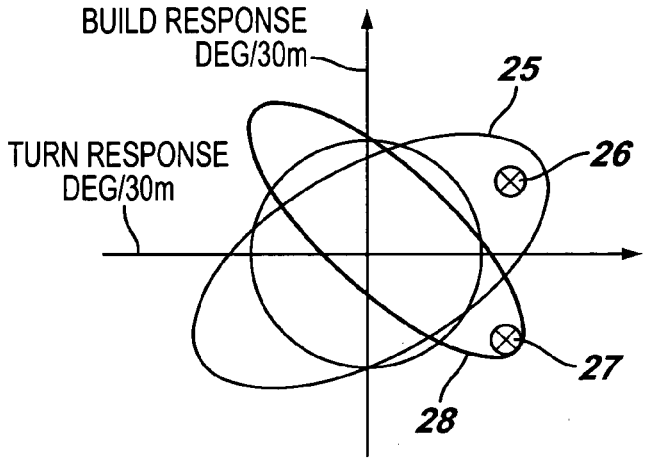
FIG. 4 is a representation of an output achieved using the method described with reference to FIG. 3.

The updated data set of the parametric model is used to calculate a range of achievable or reachable drilling directions which it is predicted can be attained under chosen drilling conditions, and this information is displayed graphically to the operator of the drilling system, for example in the form of a chart as shown in FIG. 4. As shown in FIG. 4, the chart takes the form of a graph of build rate against turn rate upon which is plotted an envelope 25 illustrating the predicted achievable drilling direction for the prevailing drilling conditions, or default conditions in the event that default data values are being used. Also plotted on the graph is the current drilling direction 26. The chart may also indicate a desired drilling direction 27 if this information has been input by the operator. Such a desired drilling direction 27 is indicated on FIG. 4.

Using the information displayed, the operator can determine whether or not it is possible to achieve the desired drilling direction 27 under the prevailing drilling conditions. This is a relatively simple task as, if the desired drilling direction 27 falls within the envelope 25 then it is achievable with the current drilling conditions, and drilling can continue with appropriate signals sent to the bias unit to urge the drill bit to drill in the desired direction.

If the desired drilling direction 27 falls outside of the envelope 25 of achievable directions (as shown in FIG. 4), then obviously if the well bore is to be drilled in the desired direction, this can only be achieved if the drilling conditions change. Although the operator has no control over a number of the drilling conditions, in particular the drilling conditions governed by the formation, he does have control over some of the drilling conditions associated with the operation of the drill bit. For example, the operator could modify the rate of penetration, weight-on-bit, or rotational speed of the drill bit. Prior to modifying the drilling conditions, the operator may input trial values of certain of the operating parameters into the control system. The control system is arranged to display the envelope 28 of achievable drilling directions for those operating conditions. If the trial values for the operating conditions result in the production of an envelope of achievable drilling directions including the desired drilling direction 27, then the operator may choose to use those drilling parameter values in the control of the drilling system and then to direct the drill bit in the desired direction. Alternatively, the control system may be set up in such a manner as to output suitable values for the drilling parameters in response to the operator entering a desired drilling direction.

Figure 6:
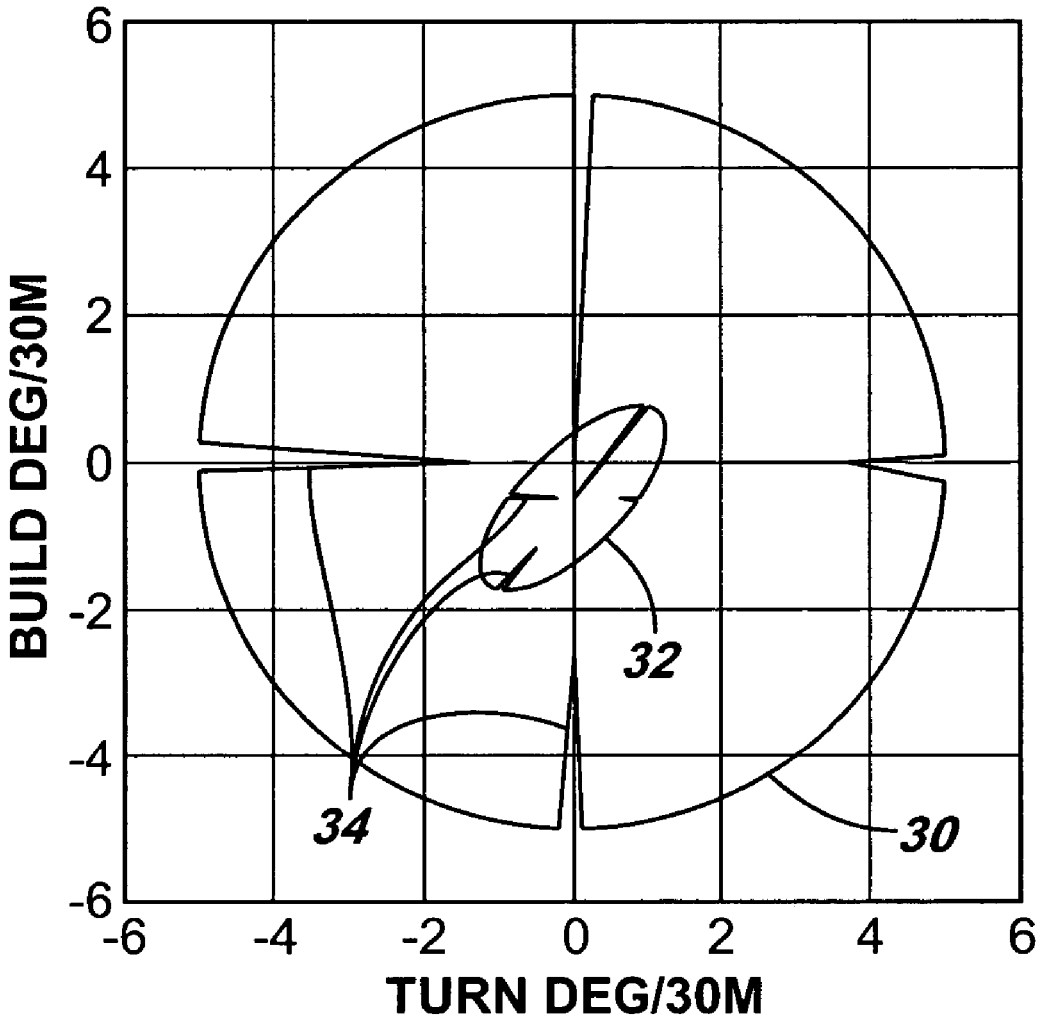
FIG. 6 is a reachability diagram produced using the method of the invention.

FIG. 6 illustrates an alternative form of reachability diagram. In this form of reachability diagram, an ideal response is illustrated, this response being denoted by numeral 30. The ideal response is shown as being circular, suggesting that the response of the drilling system to a change in drilling conditions is entirely symmetrical. The diagram further includes a predicted achievable response denoted by numeral 32, this response being equivalent, in many respects, to the envelope 25 plotted on the graph of FIG. 3, and showing the range of drilling directions which it is predicted can be attained under given operating conditions. As shown, the predicted achievable response 32 takes the form of a distorted, shifted and rotated ellipse which is derived by modifying the ideal response using the calculated gain and bias responsiveness values (see below) of the system. Both the ideal response 30 and the predicted achievable response 32 are provided with notches 34 of varying sizes provided to assist an operator in comparing the predicted achievable response with the ideal response which would be achieved under ideal drilling conditions. The operator can use the reachability diagram to determine the size of doglegs or the like which can be formed, and to determine when a dogleg in a given direction is not attainable under given operating conditions.

A number of different algorithms may be used in the calculation of the envelope of achievable drilling directions.

In one simple technique, the response of the system to a given input is used to calculate gain values $K_B$ and $K_T$, cross-coupling values $C_{BT}$ and $C_{TB}$ and bias values $B_{bias}$ and $T_{bias}$ (where B and T represent Build and Turn respectively).

The build and turn responsiveness values are then calculated by, for each factor influencing the responsiveness of the system to a steering command, calculating a normalised deviation of the parameter value from the mean value of that parameter and multiplying the deviation by a coefficient representative of the responsiveness of the system to that one of the factors, and adding the results for each factor to one another and to the relevant ones of the gain, cross-coupling and bias values. These calculations can be expressed by the following equations:

$$Build = W_{build} * \left[\frac{WOB - meanWOB}{meanWOB}\right] + R_{build} * \left[\frac{ROP - meanROP}{meanROP}\right] + P_{build} * \left[\frac{Pressure - meanPressure}{meanPressure}\right] + F_{build} * \left[\frac{Flow - meanFlow}{meanFlow}\right] + M_{build} * \left[\frac{RPM - meanRPM}{meanRPM}\right] + T_{build} * \left[\frac{Torque - meanTorque}{meanTorque}\right] + I_{build} * \left[\frac{\sin Inc - mean\sin Inc}{mean\sin Inc}\right] + K_B * [BuildDemand\%] + C_{BT} * [TurnDemand\%] + build_{bias}$$

and $$Turn = W_{turn} * \left[\frac{WOB - meanWOB}{meanWOB}\right] + R_{turn} * \left[\frac{ROP - meanROP}{meanROP}\right] + P_{turn} * \left[\frac{Pressure - meanPressure}{meanPressure}\right] + F_{turn} * \left[\frac{Flow - meanFlow}{meanFlow}\right] + M_{turn} * \left[\frac{RPM - meanRPM}{meanRPM}\right] + T_{turn} * \left[\frac{Torque - meanTorque}{meanTorque}\right] + I_{turn} * \left[\frac{\sin Inc - mean\sin Inc}{mean\sin Inc}\right] + K_T * [TurnDemand\%] + C_{TB} * [BuildDemand\%] + turn_{bias}$$

As mentioned above, other mathematical techniques may be used in the derivation of the envelopes of achievable steering directions.

Rather than use the method to determine which steering directions are achievable for a given set of drilling conditions, or to determine sets of drilling conditions which can be used to achieve steering in a chosen direction, the method may be used to determine achievable rates of penetration for a given set of drilling conditions. Such use of the method may have the advantage that the rate of penetration can be optimised.

Although the description hereinbefore related to the use of a specific type of steerable system, it will be appreciated that the invention is not restricted to the use of the method with the described drilling system and that the invention could be used with a range of other drilling systems.

What is claimed is:

1. A method of predicting the operation of a steerable drilling system comprising the steps of:

calculating an ideal reachability ellipse using the equations:

$$Build = W_{build} * \left[\frac{WOB - meanWOB}{meanWOB}\right] + R_{build} * \left[\frac{ROP - meanROP}{meanROP}\right] + P_{build} * \left[\frac{Pressure - meanPressure}{meanPressure}\right] + F_{build} * \left[\frac{Flow - meanFlow}{meanFlow}\right] + M_{build} * \left[\frac{RPM - meanRPM}{meanRPM}\right] + T_{build} * \left[\frac{Torque - meanTorque}{meanTorque}\right] + I_{build} * \left[\frac{\sin Inc - mean\sin Inc}{mean\sin Inc}\right] + K_B * [BuildDemand\%] + C_{BT} * [TurnDemand\%] + build_{bias}$$

and $$Turn = W_{turn} * \left[\frac{WOB - meanWOB}{meanWOB}\right] + R_{turn} * \left[\frac{ROP - meanROP}{meanROP}\right] + P_{turn} * \left[\frac{Pressure - meanPressure}{meanPressure}\right] + F_{turn} * \left[\frac{Flow - meanFlow}{meanFlow}\right] + M_{turn} * \left[\frac{RPM - meanRPM}{meanRPM}\right] + T_{turn} * \left[\frac{Torque - meanTorque}{meanTorque}\right] + I_{turn} * \left[\frac{\sin Inc - mean\sin Inc}{mean\sin Inc}\right] + K_T * [TurnDemand\%] + C_{TB} * [BuildDemand\%] + turn_{bias}$$

inputting data representative of actual drilling conditions into a parametric model;

calculating predicted build and turn gain, cross-coupling and bias values to derive build and turn responsiveness values attainable under given operating conditions from the parametric model to produce a predicted reachability ellipse;

plotting the predicted reachability ellipse and ideal reachability ellipse on a diagram to compare the predicted build and turn responsiveness to the ideal response for one or more sets of operating conditions.

2. A method as claimed in claim 1, wherein the model data includes data representative of at least one of: weight on bit, rotational speed, rate of progress, torque, pressure, inclination, dip and azimuth of bedding planes or other formation characteristics, hole curvature/gauge or other geometric conditions, bit type and condition, and errors in instrumentation readings.

3. A method as claimed in claim 1, wherein an output signal is produced which is used to control a display on which the predicted reachability ellipse diagram is displayed to provide an operator with information for use in controlling the operation of the drilling system.

* * * * *